United States Patent [19]

Yuhara et al.

[11] 4,334,937

[45] Jun. 15, 1982

[54] PROCESS FOR IMPROVING DECARBURIZATION RESISTANCE OF CHROME-MOLYBDENUM STEEL IN SODIUM

[75] Inventors: Shunichi Yuhara; Naruo Hasegawa; Takashi Nakasuji, all of Mito; Norichika Aoki, Atsugi, all of Japan

[73] Assignee: Doryokuro Kakunenryo Kaihatsu Jigyodan, Tokyo, Japan

[21] Appl. No.: 162,612

[22] Filed: Jun. 24, 1980

[30] Foreign Application Priority Data

Jul. 12, 1979 [JP] Japan ..... 54-88572

[51] Int. Cl.[3] ..... C22F 0/00

[52] U.S. Cl. ..... 148/12 R; 148/12 F; 148/12.3

[58] Field of Search ..... 148/12.3, 12 R, 12 F

[56] References Cited

U.S. PATENT DOCUMENTS

| | | | |
|---|---|---|---|
| 3,344,000 | 9/1967 | Baldy et al. | 148/12.3 |
| 3,388,011 | 6/1968 | Zackay et al. | 148/12.3 |
| 3,788,903 | 1/1974 | Suzuki et al. | 148/12.3 |

*Primary Examiner*—W. Stallard

*Attorney, Agent, or Firm*—Wenderoth, Lind & Ponack

[57] ABSTRACT

A process for improving decarburization resistance of chrome-molybdenum steel in sodium is provided which comprises subjecting the chrome-molybdenum steel to cold working to attain a working ratio of not less than 5%, thereby forming numerous nuclei for carbide formation in the steel material, and heat-treating the cold-worked steel to form stable, fine carbide particles. Alternatively, by subjecting the steel material to warm working at a temperature of 600° to 750° C., both the working step and the heat treatment step can be accomplished in one step.

4 Claims, 6 Drawing Figures

1 μm

1 μm

PROCESS FOR IMPROVING DECARBURIZATION RESISTANCE OF CHROME-MOLYBDENUM STEEL IN SODIUM

BACKGROUND OF THE INVENTION

The present invention relates to a process for imparting decarburization resistance to chrome-molybdenum steel. More particularly, the present invention relates to a process for obtaining a steel material suitable for use as a structural material of a sodium-heated steam generator in a liquid metal fast breeder reactor or of a nuclear fusion reactor in which lithium is used.

The term "chrome-molybdenum steel" herein indicates a steel corresponding to any of STPA24, STBA24 and SCMV4 specified in JIS (Japanese Industrial Standard) G3458, G3462 and G4109, respectively (see JIS Handbook, Steel (1979) published by Japanese Standards Association).

As heat-transfer pipe material of, for example, a sodium-heated steam generator in fast breeder reactor, there has been used a material obtained by annealing 2.25 Cr-1 Mo steel at 920°–940° C. and then furnace-cooling the same, or a material obtained by normalizing 2.25 Cr-1 Mo steel and then tempering the same. However, when such a material as thus treated is used in sodium at a high temperature, the carbon concentration of the material is reduced (decarburized). The decarburization rate is considerably high. Carbon incorporated in the material to form a solid solution so as to enhance the strength of the material, or carbon formed by the decomposition of carbides in the material, is dissolved into sodium and thus the strength of the material is weakened.

Various investigations have heretofore been made to reduce the decarburization rate and to enhance the decarburization resistance. For enhancing the decarburization resistance, it is effective to react carbon contained in the material in the form of a solid solution with iron, chromium, molybdenum and other minor constituents of the material to form stable carbides in the material. As a process for forming carbides in the material, heat treatment at a temperature of about 700° C. for 0.5 to 3 hours has been proposed. However, according to the conventional heat treatment, the degree of reduction in the rate of decarburization is low, though the decarburization rate can be reduced to some extent. Further, carbide particles formed in the material by the conventional heat treatment become partially coarse. This is unfavorable from the viewpoint of the mechanical strength of the material at high temperature.

SUMMARY OF THE INVENTION

An object of the present invention is to provide a process for imparting decarburization resistance to chrome-molybdenum steel.

Another object of the present invention is to provide a process for obtaining decarburization-resistant chrome-molybdenum steel in which numerous stable, fine carbide particles are formed.

Further object of the present invention is to provide a structural steel material of, for example, a sodium-heated steam generator in a fast breeder reactor, said material exhibiting reduced degree of deterioration with time, and improved performance, reliability and safety of the steam generator.

According to one embodiment of the present invention, chrome-molybdenum steel is first subjected to cold working to attain a working ratio of not less than 5% to thereby form numerous nuclei for carbide formation in the steel material. The thus cold-worked steel material is then heat-treated to form stable, fine carbide particles in the material. The heat treatment is carried out preferably at about 600° to 750° C. for 0.5 to 10 hours. The cycle of the cold working and heat treatment may be repeated two or more times to increase the working ratio, thereby increasing the decarburization resistance.

In another embodiment of the present invention the working for forming nuclei for carbide formation and the heat treatment are accomplished in one step by warm-working the chrome-molybdenum steel at a temperature of 600° to 750° C. to attain a working ratio of not less than 5%. The thus warm-worked steel material may be subjected to additional heat treatment at a temperature of 600° to 750° C. to accelerate the formation of the stable, fine carbide particles in the material.

The term "working ratio" as used in this application means the degree of plastic working such as forging, rolling, extrusion, pressing and the like. The working ratio is expressed by an amount of strain in the worked material, and includes forging ratio for forging, reduction ratio or draft ratio for rolling, and the like.

These and other objects and many advantages of the invention will become apparent from the following detailed description in conjunction with the accompanying drawings.

DETAILED DESCRIPTION OF THE INVENTION

Figure 1:
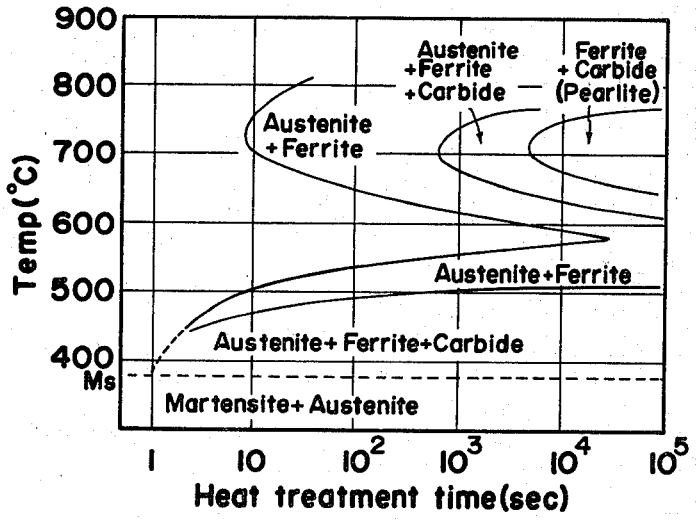
FIG. 1 shows an isothermal transformation diagram of 2.25 Cr-1 Mo steel.

The present invention will be illustrated with reference to drawings and in comparison with the prior art. As described above, if chrome-molybdenum steel is exposed to sodium at a high temperature for a long period of time, carbon incorporated in the material to form a solid solution so as to maintain or to enhance the strength of the material, or carbon formed by the decomposition of carbides formed in the material, is dissolved (hereinafter referred to as "decarburized") in sodium, thereby reducing the strength of the material. For enhancing the decarburization resistance, it is effective to react the carbon contained in the material in the form of a solid solution with iron, chromium, molybdenum and other minor constituents of the material to form stable carbides in the material. There has been employed a process wherein the heat treatment is effected at a temperature of about 700° C. for 0.5 to 3 hours to form stable carbides in the material as shown by the isothermal transformation diagram in FIG. 1. However, by the mere heat treatment, it is impossible to sufficiently control size, distribution and species of the carbide particles formed by the heat treatment or during the use after the heat treatment.

Figure 2A:
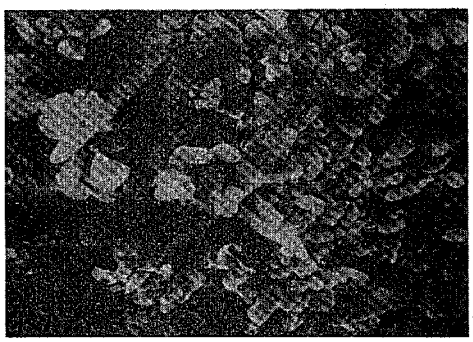
FIGS. 2(A) and 2(B) are photomicrographs of Cr-Mo steel treated by a conventional process and the process of the present invention, respectively.
Figure 2B:
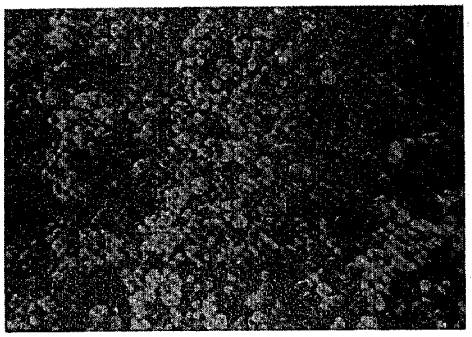

After intensive investigations, the inventors have found that it is necessary to form numerous stable, fine carbides in the material in order to improve the decarburization resistance and to prevent the reduction in strength of the material. In this connection, if the material is subjected to cold working, numerous slips are caused in the crystals and the carbides are formed at these crystal irregularities which act as the nuclei for carbide formation and growth. The first embodiment of the present invention comprises subjecting chrome-molybdenum steel to cold working to attain a working ratio of not less than 5%, thereby forming numerous nuclei for carbide formation in the material, and heat-treating the chrome-molybdenum steel to form stable, fine carbides. FIG. 2(A) is a photomicrograph of steel material treated by a conventional process in which the material was subjected to heat treatment at 920° C. and then to furnace-cooling at the rate of 100° C. per hour. FIG. 2(B) is a photomicrograph of steel material treated by the process of the present invention in which the steel material of FIG. 2(A) was further subjected to cold working to attain a working ratio of 90% and then to heat treatment at 700° C. for 432 hours. It will be understood that if cold working is effected previously to the heat treatment, nuclei for the carbide formation are increased in number, carbide particles become smaller in size and the carbide particles are increased in number, while if merely the heat treatment is effected, the nuclei for the carbide formation are small in number and the carbide particles are larger in size.

Figure 3:
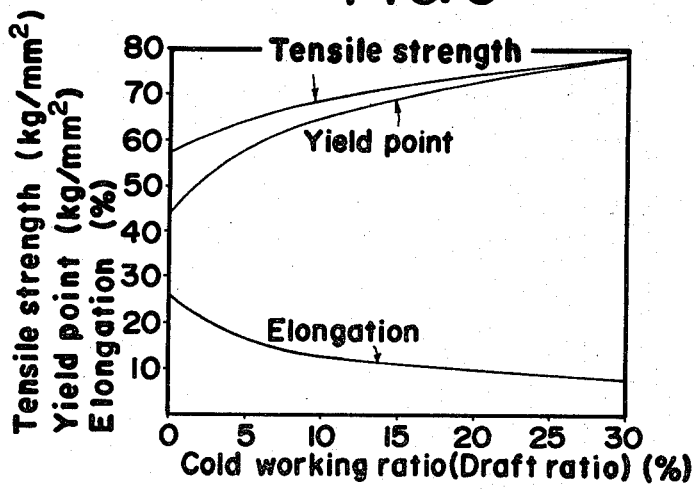
FIG. 3 shows relationships between cold working ratio (draft ratio) of a carbon steel (carbon content: 0.30%) and mechanical properties thereof.

Though the above material has been cold-worked to a working ratio of about 90%, it is known that mechanical properties of carbon steels vary considerably at a working ratio of about 5% as shown in FIG. 3. Thus, it is considered that the nuclei for the carbide formation are increased in number at a working ratio of about 5% and above.

Figure 4:
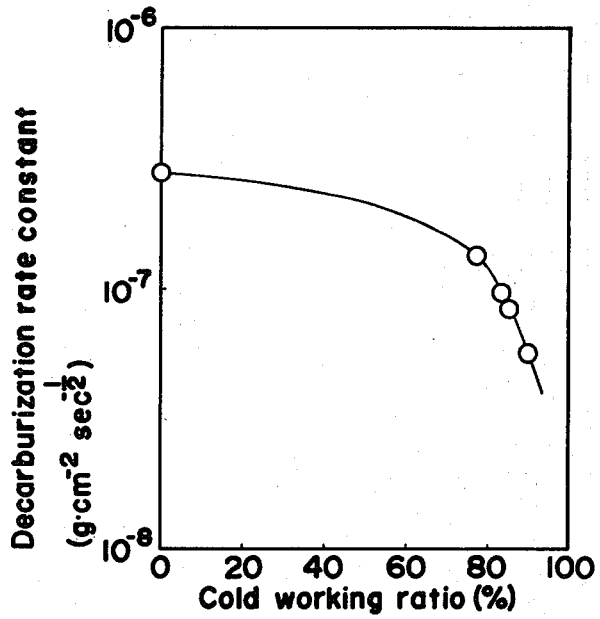
FIG. 4 shows a relationship between decarburization rate constant and cold working ratio.

A relationship between ratio of cold-working and decarburization rate in liquid sodium was examined to obtain the results shown in FIG. 4. In the graph shown in FIG. 4, the decarburization rate constant ($g.cm^{-2}.sec^{-\frac{1}{2}}$) is defined by the slope of a straight line which is obtained by plotting the total mass of carbon lost per unit area vs the square root of time. (See, "Decarburization Kinetics of Low Alloy Ferritic Steels in Sodium" by J. L. Krankota et al., METALLURGICAL TRANSACTIONS, vol 3, p. 2515–2523, September 1972.) It is understood from FIG. 4 that a higher ratio of cold-working is recommended for reducing the decarburization rate. Namely, the larger the number of nuclei for the carbide formation in the material, the better the results.

Practically, however, the working ratio in one step of the cold working is, at the highest, about 50%. Therefore, in fact, it is preferred to repeat the cycles of cold working and heat treatment. By this technique, heterogeneity of the crystal irregularities in the direction of thickness formed by the cold working, as well as the total combined ratio of cold working, can be improved. More particularly, carbides are formed by the first cold working and heat treatment and then some deformable and breakable particles of the carbides formed in the first treatment are deformed by the second cold working, thereby reducing the particle size of the carbides and further completing the carbide formation from the carbon still remaining unchanged after the first treatment. Thus, fine carbide particles are formed in a large amount.

Now, description will be made on the working ratio. If the cold working is conducted to a working ratio of 5%, sometimes the treatment has not been effected in the central part of the material when the material is thick. Generally, in the treatment of low alloy steels, influence of working ratio is negligible if it is not greater than 15%. Thus, in practice, a working ratio of not less than 15% is preferred.

Figure 5:
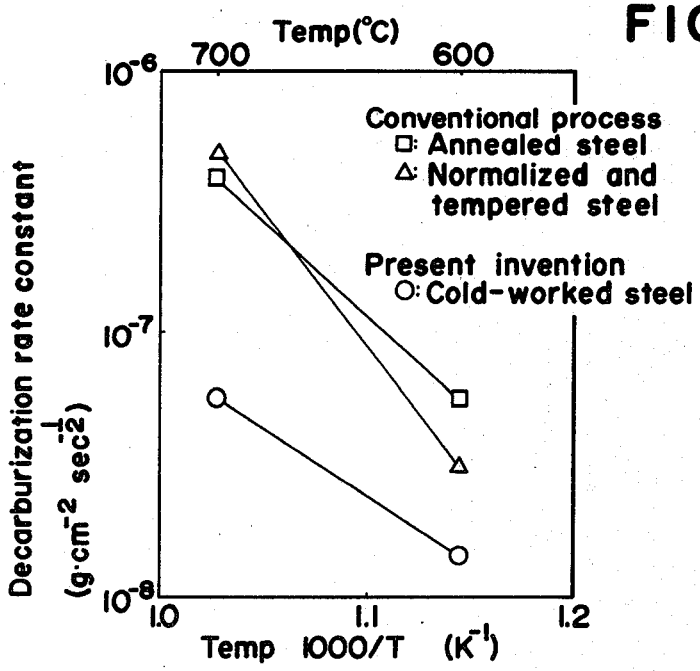
FIG. 5 shows relationships between decarburization rate constant and heat treatment processes.

Relationships between decarburization rate in liquid sodium and heat treatment temperature are shown in FIG. 5. The materials were heat-treated at 600° to 750° C. for 0.5 to 10 hours. It will be understood from FIG. 5 that effects of the process of the present invention (i.e. effects of the cold-worked material) are superior to those of the conventional processes.

The second embodiment of the present invention is a process in which working for forming the nuclei for the carbide formation and the heat treatment for forming carbides at the nuclei are accomplished in one step. Namely, this process comprises subjecting chrome-molybdenum steel to warm working at a temperature of 600° to 750° C. to attain a working ratio of not less than 5%, thereby forming a large quantity of stable, fine carbides in the materials. This temperature range is below a temperature at which recrystallization is caused. By this process, slips are apt to be caused in the crystals and, therefore, numerous nuclei for the carbide formation are formed in the material. Simultaneously with the formation of the nuclei, at the temperature employed in this warm working, stable and fine carbide particles are formed in a large quantity at the nuclei. Consequently, the decarburization rate can be reduced. For the same reasons as in the first embodiment of the invention, it is preferred to effect the warm working repeatedly.

The third embodiment of the present invention comprises the warm working in the second embodiment followed by additional heat treatment of the warm-worked material at 600° to 750° C. for 0.5 to 10 hours. By this additional heat treatment, the formation of the stable fine carbide particles at the nuclei for the carbide formation can be accelerated.

Materials used in the above-described experiments are STBA24 specified in JIS G3462 (see JIS Handbook, Steel (1979) published by Japanese Standards Association).

According to the present invention as described above in detail, numerous fine nuclei for the carbide formation are formed and the carbides are formed at the nuclei. Therefore, as compared with conventional processes, the decarburization rate can be reduced considerably as shown in FIGS. 4 and 5. Thus, if the material treated by the process of the present invention is used as, for example, a sodium-heated steam generator in a fast breeder reactor, the degree of deterioration thereof with age can be reduced and performance, reliability and safety of the steam generator can be remarkably improved.

While the effect of the present invention has been described with respect to the decarburization resistance in liquid sodium, it should be noted that a similar effect is expected with respect to the decarburization resistance in liquid lithium.

What is claimed is:

1. A process for improving the decarburization resistance of a chrome-molybdenum steel, comprising subjecting the chrome-molybdenum steel to warm working at a temperature of 600° to 750° C. to attain a working ratio of not less than 5% to form a large quantity of stable, fine carbide particles in the steel material.

2. A process according to claim 1, wherein the warm working is carried out repeatedly.

3. A process according to claim 1, wherein the process further comprises heat-treating the warm-worked steel at a temperature of 600° to 750° C. for a period of time from 30 minutes to 10 hours.

4. A process according to claim 1, 2 or 3, wherein the working ratio is not less than 15%.

* * * * *

UNITED STATES PATENT AND TRADEMARK OFFICE

CERTIFICATE OF CORRECTION

PATENT NO. : 4,334,937

DATED : June 15, 1982

INVENTOR(S) : Shunichi YUHARA, Naruo HASEGAWA, Takashi NAKASUJI and Norichika AOKI It is certified that error appears in the above-identified patent and that said Letters Patent are hereby corrected as shown below:

On the title page:

In the heading of the patent, change the name of the Assignees to --DORYOKURO KAKUNENRYO KAIHATSU JIGYODAN and CENTRAL RESEARCH INSTITUTE OF ELECTRIC POWER INDUSTRY, both of Tokyo, Japan.--.

Signed and Sealed this

*Eleventh* Day of *January 1983*

[SEAL]

*Attest:*

GERALD J. MOSSINGHOFF

*Attesting Officer*

*Commissioner of Patents and Trademarks*